US010874261B2

(12) United States Patent
Primucci et al.

(10) Patent No.: US 10,874,261 B2
(45) Date of Patent: Dec. 29, 2020

(54) MULTI-SECTION BATHING STRUCTURES

(71) Applicant: Mirolin Industries Corp, Etobicoke (CA)

(72) Inventors: Dominic Primucci, Toronto (CA); Rayman Alli, North York (CA)

(73) Assignee: Mirolin Industries Corp., Etobicoke (CA)

( * ) Notice: Subject to any disclaimer, the term of this patent is extended or adjusted under 35 U.S.C. 154(b) by 0 days.

(21) Appl. No.: 16/426,721

(22) Filed: May 30, 2019

(65) Prior Publication Data

US 2020/0000288 A1 Jan. 2, 2020

Related U.S. Application Data

(60) Provisional application No. 62/691,847, filed on Jun. 29, 2018.

(51) Int. Cl.
*A47K 3/08* (2006.01)

(52) U.S. Cl.
CPC ..... *A47K 3/08* (2013.01)

(58) Field of Classification Search
CPC ..... A47K 3/08
USPC ..... 4/584, 538
See application file for complete search history.

(56) References Cited

U.S. PATENT DOCUMENTS 4,473,911 A * 10/1984 Germain ..... A47K 3/001 4/559
4,578,832 A 4/1986 Primucci
D397,772 S * 9/1998 McKeone ..... A47K 3/30 D23/277
5,970,536 A 10/1999 Suarez
6,425,147 B1 * 7/2002 Hanson ..... A47K 3/30 4/584
6,434,764 B2 8/2002 Primucci
(Continued)

FOREIGN PATENT DOCUMENTS

CN 201485978 U 5/2010
CN 202537919 U 11/2012
DE 4214443 C1 11/1993

OTHER PUBLICATIONS

Swann; Patent Specification 7046; Application Accepted May 22, 1902; 6 pages.

(Continued)

*Primary Examiner* — Lori L Baker
(74) *Attorney, Agent, or Firm* — Reising Ethington P.C.

(57) ABSTRACT

A basin section, wall section, and a canopy section for a multi-section bathing structure are disclosed. Each of the basin and wall sections include a wall including an offset wall portion including an upper portion extending in a generally vertical direction, and an outboard trough portion including a flange extending away from the upper portion in a generally horizontal direction, and a rim extending away from the flange in a generally vertical direction. The canopy section includes a canopy roof, a canopy wall extending in a direction away from the canopy roof, and including a canopy section lower end extending in a generally vertical direction and a canopy outboard flange extending away from the canopy section lower end in a generally horizontal direction and axially terminating the canopy wall. Each of the sections also may include a section reinforcement and a latch portion coupled to the section reinforcement.

14 Claims, 4 Drawing Sheets

(56) References Cited

U.S. PATENT DOCUMENTS

| | | | | |
|---|---|---|---|---|
| 7,634,823 | B2 | 12/2009 | Sisk | |
| 8,082,608 | B2 * | 12/2011 | Dabrowski | A47K 3/16 4/584 |
| 9,009,881 | B2 | 4/2015 | Sisk | |
| 9,226,623 | B2 * | 1/2016 | Geels | A47K 3/284 |
| 9,416,538 | B2 * | 8/2016 | Torres | A47K 3/161 |
| 9,877,615 | B2 * | 1/2018 | Ahmes | A47K 3/02 |
| 2007/0074574 | A1 | 4/2007 | Miller | |
| 2009/0172875 | A1 * | 7/2009 | Dabrowski | A47K 3/04 4/584 |
| 2011/0214230 | A1 * | 9/2011 | Bates | A47K 3/02 4/584 |
| 2014/0259362 | A1 * | 9/2014 | Zimbric | A47K 3/161 4/584 |

OTHER PUBLICATIONS

Parkin, et al.; Patent Specification 857,075; Published Dec. 29, 1960; 5 pages.

Microlin; Owners Manual "2 Piece Domeless Tub Shower"; 2011; 10 pages.

* cited by examiner

MULTI-SECTION BATHING STRUCTURES

TECHNICAL FIELD

This disclosure relates generally to bathing structures and, more particularly, to prefabricated multi-section bathing structures.

BACKGROUND

Prefabricated two-section bathing structures typically include a bathtub or a shower basin, and a wall section carried on the bathtub or the shower basin. Prefabricated three-section shower structures usually further include a canopy section carried on the wall section. In either case, the various sections are ordinarily fastened together using brackets and nut and bolt fasteners straddling overlapping section joints of simple geometry, or using clips straddling section joints of complex geometry. The clips, and the nuts and bolts can become lost during assembly, may require tools, and can be time consuming to install, particularly in tight spaces where shower assemblies are often used. Also, some conventional bathing structures include simple inter-section joints that are prone to leakage or may include inter-section joints of complex geometry to prevent leakage therebetween.

DETAILED DESCRIPTION

In general, one or more illustrative embodiments of a bathing structure will be described with respect to a combined bathtub and shower structure. Of course, other embodiments of the bathing structure are contemplated, including a shower-only structure without a bathtub. From the description below, one of ordinary skill in the art will appreciate that the described bathing structure enables an assembly method that need not involve tools or complex joints between sections. Likewise, from the description below, artisans of ordinary skill will recognize that the described bathing structure enables a water management feature in the form of one or more troughs, channels, or gutters extending circumferentially around the structure, thereby reducing or preventing instances of leakage out of the structure.

Figure 1:
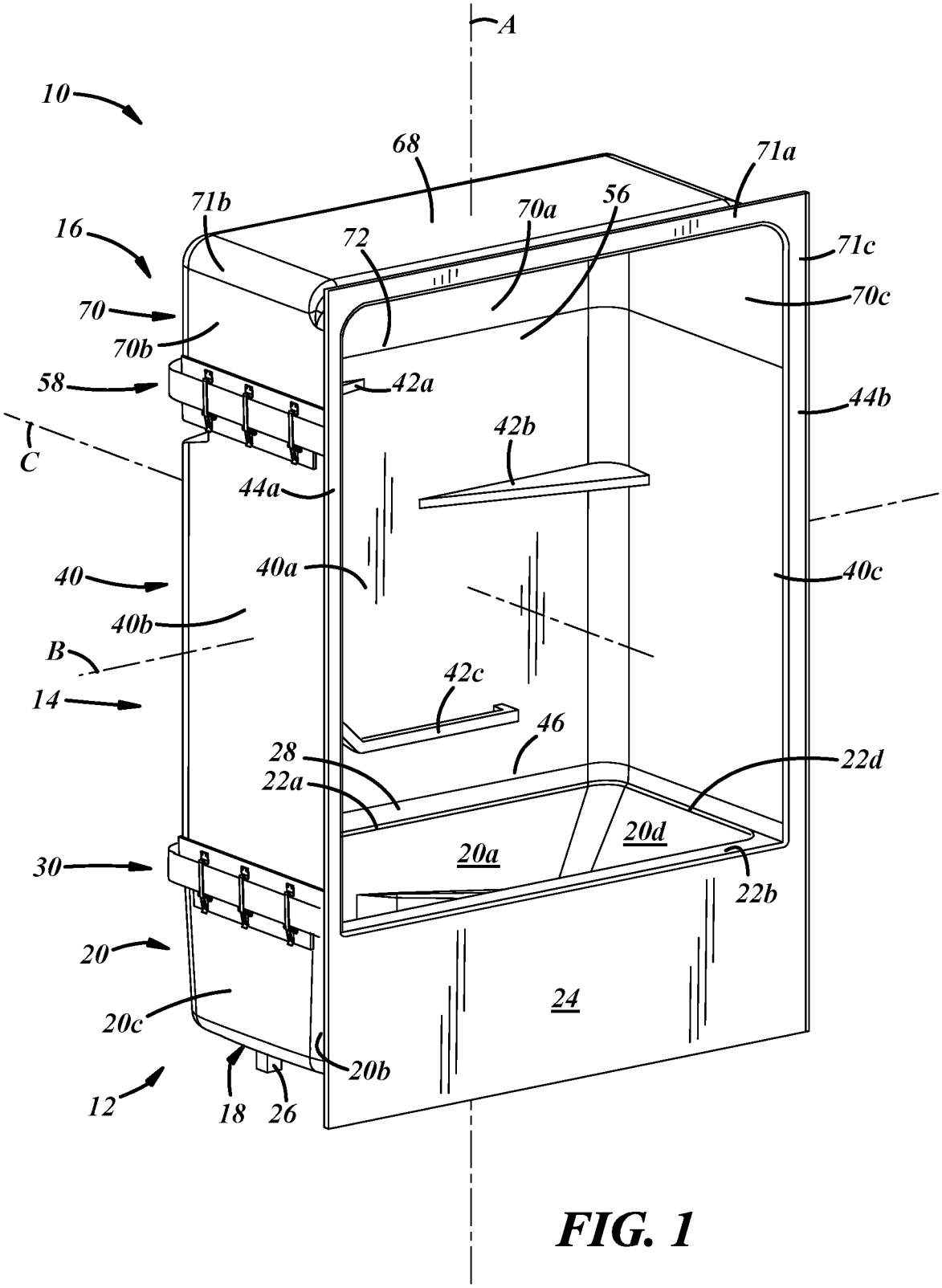
FIG. 1 is a front left perspective view according to an illustrative embodiment of a multi-section bathing structure including a basin section, a wall section, and a canopy section.
Figure 3:
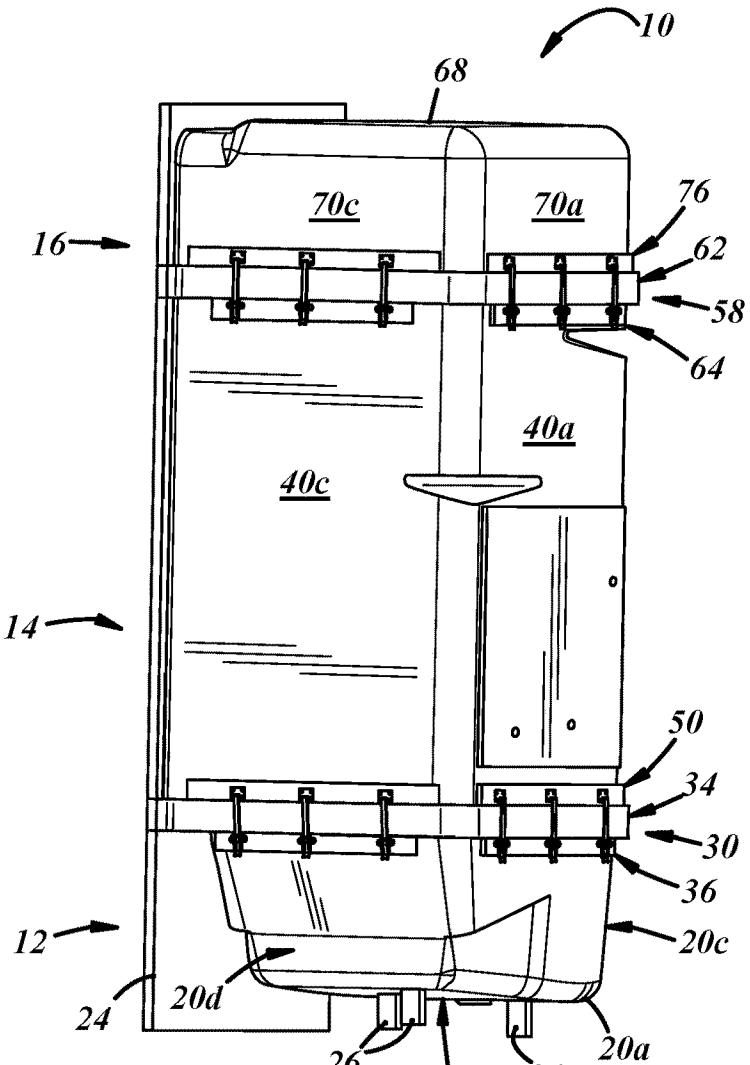
FIG. 3 is rear right perspective view of the bathing structure of FIG. 1.
Figure 2:
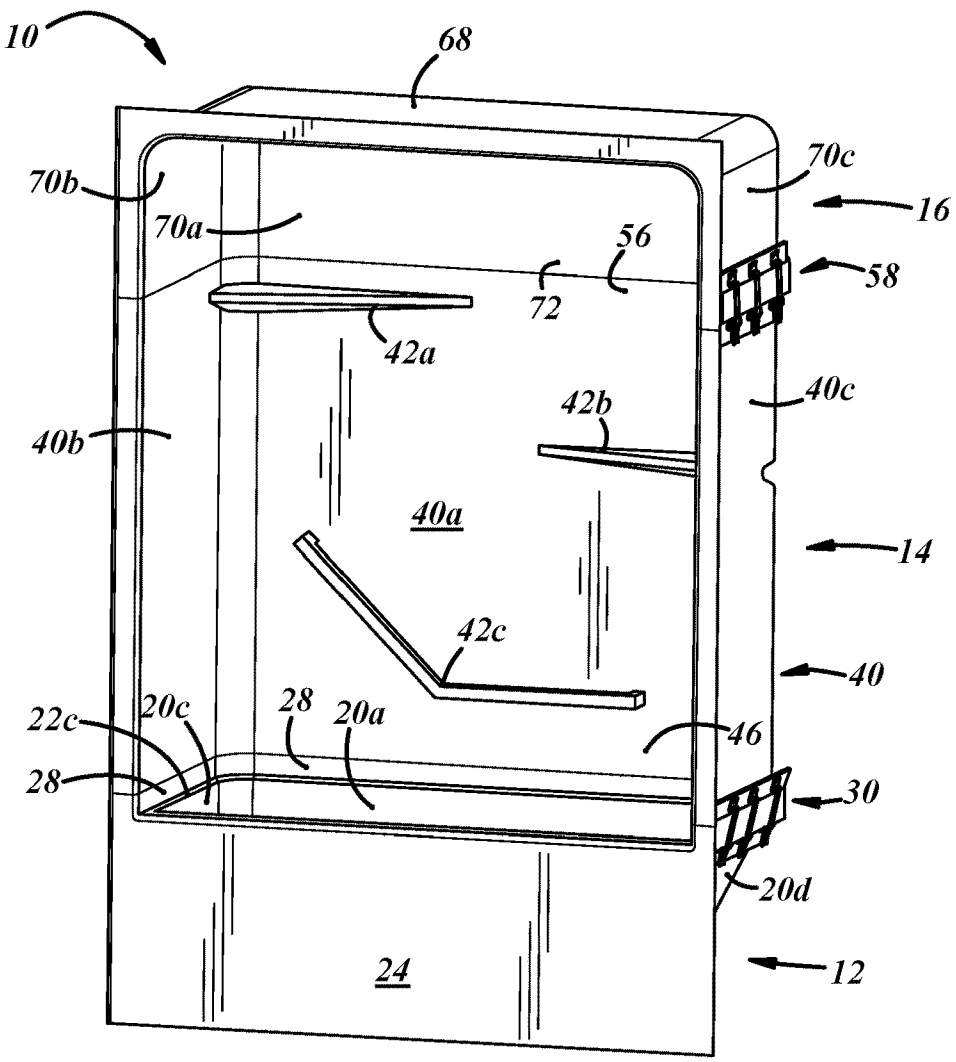
FIG. 2 is a front right perspective view of the structure of FIG. 1.

Referring generally to FIGS. 1-3 and specifically to FIG. 1, the drawing figures show an illustrative embodiment of a bathing structure 10 including a basin section 12 and a wall section 14 configured to be carried by the basin section 12. The wall section 14 also may be configured to be latched to the basin section 12. The bathing structure 10 also may include a canopy section 16 configured to be carried by the wall section 14. The canopy section 16 also may be configured to be latched to the wall section 14. The bathing structure 10 may extend, height wise along a vertical axis A, length wise along a horizontal transverse axis B, and depth wise along a horizontal normal axis C.

The various sections 10, 12, 14 of the bathing structure may be composed of polymeric material, for instance, acrylic, or any other polymeric material(s) suitable for bathtub and shower structures, and may be in the form of cast sheet, extruded sheet, gelcoat, cultured marble, or in any other form suitable for bathtub and shower structures. The various sections of the bathing structure may be vacuum formed, injection molded, thermoformed, or produced in any other manner suitable for producing such structures.

The basin section 12, in the illustrated embodiment, is in the form of a bathtub. In other embodiments, for instance, wherein the bathing structure 10 is a shower-only structure, the basin section 12 may be in the form of a shower footwell. In any case, the basin section 12 includes a basin floor 18, and basin walls 20 (20*a*, 20*b*, 20*c*, 20*d*) extending away from the basin floor 18. In the illustrated embodiment, the basin walls 20 include a far sidewall 20*a*, a near sidewall 20*b*, and end walls 20*c*, 20*d*. The basin walls 20 also may include corresponding ledges 22*a*, 22*b*, 22*c* (FIG. 2), 22*d* extending circumferentially completely around the basin section 12 and including a relatively wide near side portion 22*b* and relatively narrow far side and end portions 22*a*, 22*c*, 22*d*. Also, the basin section 12 may include a decorative skirt 24 extending downwardly from the near side ledge 22*b*. The basin section 12 further may include feet 26 extending downwardly from the basin floor to engage a building floor and thereby provide additional support for the basin section 12. The feet 26 may include components produced separately from the basin section floor 18 and walls 20, or may include portions of the floor 18 formed integrally therewith.

Figure 4:
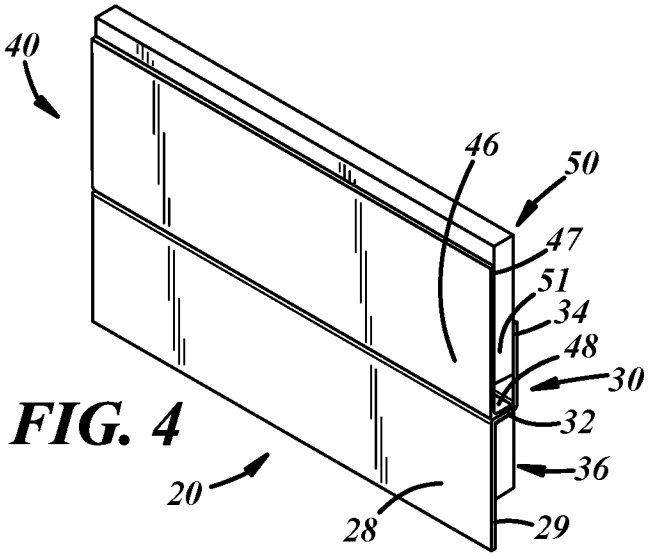
FIG. 4 is a front perspective view of a fragmentary portion of the basin and wall sections of the bathing structure of FIG. 1.
Figure 7:
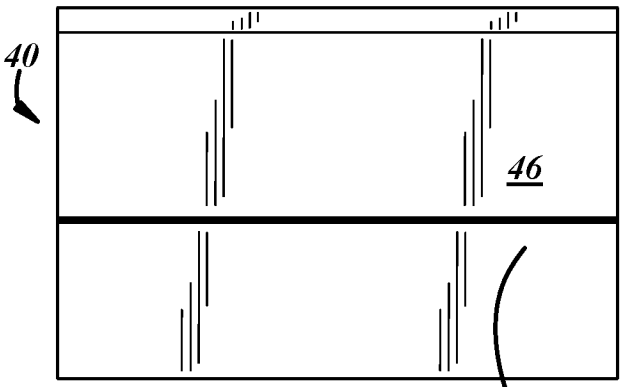
FIG. 7 is a front elevational view of the fragmentary portion of FIG. 4.

With reference generally to FIGS. 4-9, and specifically to FIG. 4, one or more of the basin walls 20 includes a basin offset wall portion including an upper inboard portion 28 extending in a generally vertical direction, and a basin outboard trough portion 30 extending away from the upper inboard portion 28. The basin outboard trough portion 30 includes a basin trough flange 32 extending away from the upper inboard portion 28 in a generally horizontal direction, and a basin trough rim 34 extending away from the basin trough flange 32 in a generally vertical direction. As used herein, the phrase "generally horizontal direction" means a direction that is disposed at an angle less than +/−45 degrees from horizontal. As used herein, the phrase "generally vertical direction" means a direction that is disposed at an angle less than +/−45 degrees from vertical.

The basin offset wall portion may axially terminate its respective wall 20. More specifically, the upper inboard portion 28 may axially terminate inboard portions of the respective basin wall 20, and the basin outboard trough portion 30 may axially terminate outboard portions of the respective basin wall 20 such that an open upper channel or gutter may be formed by the basin offset wall portion.

The basin section 12 may further include a basin section reinforcement 36, and a first latch portion 38 coupled to the reinforcement 36. The reinforcement 36 may be located below the basin outboard trough portion 30 and against a rear surface 29 of the upper inboard portion 28 of the basin section offset wall.

With reference generally to FIGS. 1-3 and specifically to FIG. 1, the wall section 14 includes walls 40, which, in the illustrated embodiment, include a far sidewall 40*a* and end walls 40*b*, 40*c*. The walls 40 also may include internal features 42*a*, 42*b*, 42*c*, for instance, shelves, soap dishes, handrails, and the like, that may be integrally formed with the walls 40. Also, the wall section 14 may include decorative flanges 44*a*, 44*b* extending outwardly from the end walls 40*b*, 40*c* and that may be coplanar with the basin section skirt 24.

With reference generally to FIGS. 4-9 and specifically to FIG. 4, one or more of the walls 40 includes a wall section lower end 46 extending in a generally vertical direction, and an outboard flange 48 extending away from the wall section lower end 46 in a generally horizontal direction. The outboard flange 48 is configured to overlap the basin trough flange 32 of the basin outboard trough portion 30 of the basin wall 20. The outboard flange 48 may axially terminate its respective wall 40. In any case, the wall section 14 may be nested within the basin outboard trough portion 30 of the basin section 12.

Figure 8:
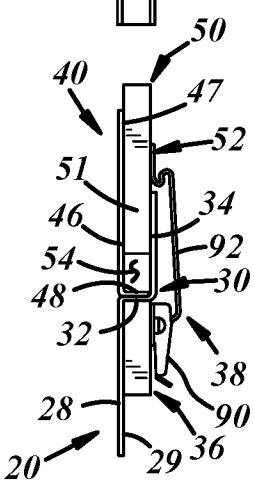
FIG. 8 is a side view of the fragmentary portion of FIG. 4.

Also, with reference to FIG. 8, the wall section 14 may include a wall section reinforcement 50 and a second latch portion 52 carried by the wall section reinforcement 50 and configured for cooperation with the first latch portion 38 to couple the basin section 12 and the wall section 14 together. The wall section reinforcement 50 may be located above the wall section outboard flange 48 and against a rear surface 47 of the wall section lower end 46.

In the illustrated embodiment, the wall section reinforcement 50 has a lower portion 51 located between the basin trough rim 34 and the wall section lower end 46 with a space 54 between the wall section outboard flange 48 and the reinforcement lower portion 51. The space 54 may establish a trough, gutter, or channel in which water may be held back by the rim 34 from flowing out of the structure 10 and into the building in which the structure 10 is used. The trough may extend circumferentially continuously around the wall section 14 from one end to the other. In other embodiments, the reinforcement lower portion 51 may have at least some portions in contact with an upper surface of the wall section outboard flange 48. In yet other embodiments, the wall section reinforcement lower portion 51 need not be located between the basin trough rim 34 and the wall section lower end 46.

Figure 10:
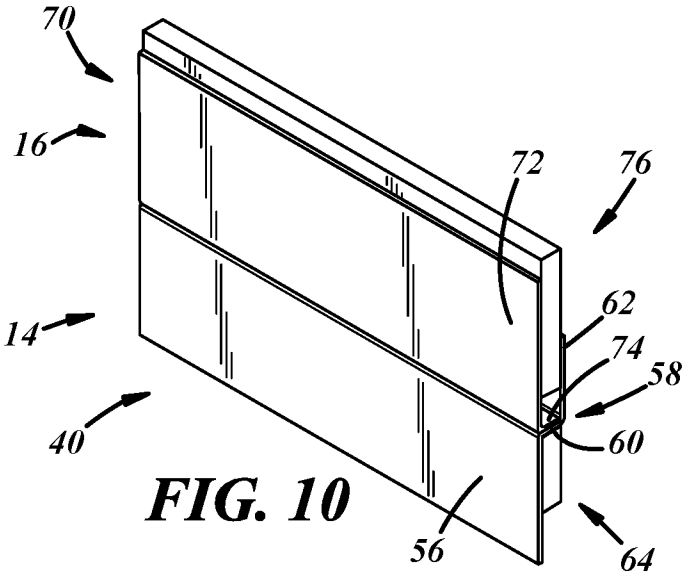
FIG. 10 is a front perspective view of a fragmentary portion of the wall and canopy sections of the bathing structure of FIG. 1.
Figure 15:
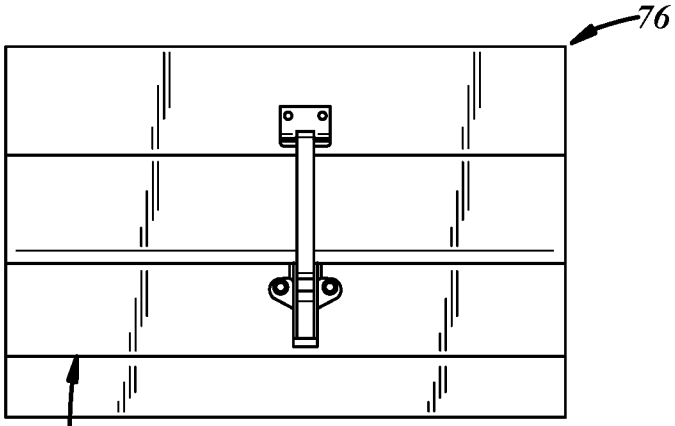
FIG. 15 is a rear elevational view of the fragmentary portion of FIG. 10.

With reference generally to FIGS. 10-15 and specifically to FIG. 10, as shown in the illustrated embodiment, the wall section 14 also may include an offset wall portion including a wall section upper inboard portion 56 extending in a generally vertical direction, and a wall outboard trough portion 58 extending away from the wall section upper inboard portion 56. The trough portion 58 includes a wall trough flange 60 extending away from the wall section upper inboard portion 56 in a generally horizontal direction, and a wall trough rim 62 extending away from the wall trough flange 60 in a generally vertical direction. The offset wall portion may axially terminate its respective wall 40. More specifically, the wall section upper inboard portion 56 may axially terminate inboard portions of the respective wall 40, and the wall outboard trough portion 58 may axially terminate outboard portions of the respective wall 40 such that an open upper channel or gutter may be formed by the offset wall portion.

The wall section 14 may further include an upper wall section reinforcement 64 located below the wall outboard trough portion 58 and another first latch portion 66 coupled to the upper wall section reinforcement 64. The reinforcement 64 may be located against a rear surface 57 of the wall section upper inboard portion 56.

With reference generally to FIGS. 1-3 and specifically to FIG. 1, the canopy section 16 may include a canopy roof 68, and canopy walls 70 (70*a*, 70*b*, 70*c*) extending in a direction away from the canopy roof 68. Also, the canopy section 16 may include decorative flanges 71*a*, 71*b*, 71*c* extending outwardly from the canopy walls 70 and that may be coplanar with the basin section skirt 24 and the wall flange 44*a*, 44*b*.

With reference generally to FIGS. 10-15 and specifically to FIG. 10, one or more of the canopy walls 70 may include a canopy section lower end 72 extending in a generally vertical direction, and a canopy outboard flange 74 extending away from the canopy section lower end 72 in a generally horizontal direction and configured to overlap the wall outboard trough portion 58. The canopy outboard flange 74 may axially terminate its respective wall 70. In any case, the canopy section 16 may be nested within the wall outboard trough portion 58 of the wall section 14.

Figure 14:
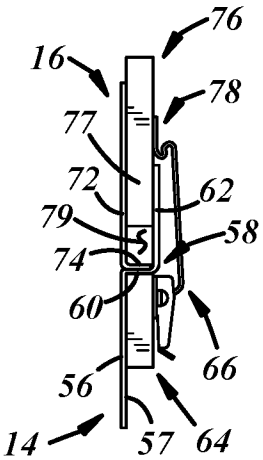
FIG. 14 is a side view of the fragmentary portion of FIG. 10.
Figure 13:
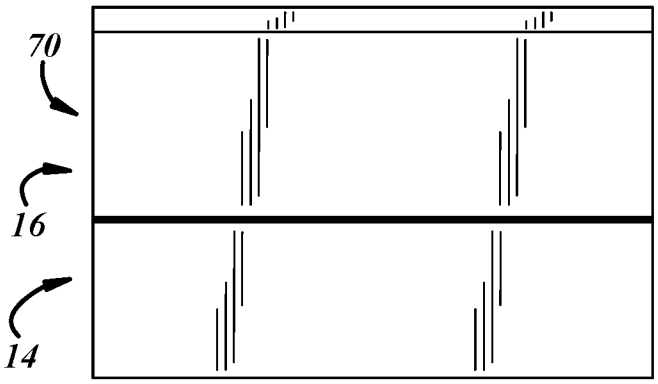
FIG. 13 is a front elevational view of the fragmentary portion of FIG. 10.

With reference to FIG. 14, the canopy section 16 also may include a canopy section reinforcement 76 and another second latch portion 78 carried by the canopy section reinforcement 76 and configured for cooperation with the other first latch portion 66 to couple the canopy section 16 and the wall section 14 together. The reinforcement 76 may be located against a rear surface 73 of the canopy section lower end 72.

In the illustrated embodiment, the canopy section reinforcement 76 has a lower portion 77 located between the wall trough rim 62 and the canopy section lower end 72 with a space 79 between the canopy section outboard flange 74 and the reinforcement lower portion 77. The space 79 may establish a trough, gutter, or channel in which water may be held back by the rim 62 from flowing out of the structure 10 and into the building in which the structure 10 is used. The trough may extend circumferentially continuously around the wall section 14 from one end to the other. In other embodiments, the reinforcement lower portion 77 may have at least some portions in contact with an upper surface of the wall section outboard flange 74. In yet other embodiments, the wall section reinforcement lower portion 77 need not be located between the wall trough rim 62 and the canopy section lower end 72.

In the illustrated embodiment, the reinforcements 36, 50, 66, 76 are longitudinally extending strips, having lengths greater than their widths and thicknesses. Also, the reinforcements 36, 50, 66, 76 may be composed of polymeric material such as extruded plastic, wood or plywood, composites, or any other material suitable for use in reinforcing bathtub and shower structures. Further, in the illustrated embodiment, the reinforcements 36, 50, 66, 76 may be components separate from their respective sections. In that case, the reinforcements 36, 50, 66, 76 may be adhered to their respective sections after the sections are formed, insert formed or molded to their respective sections, interference fit to corresponding formations of their respective section, or otherwise coupled to their respective sections in any other suitable manner. In other embodiments, the reinforcements 36, 50, 66, 76 may be integrally formed portions of their respective sections.

Figure 6:
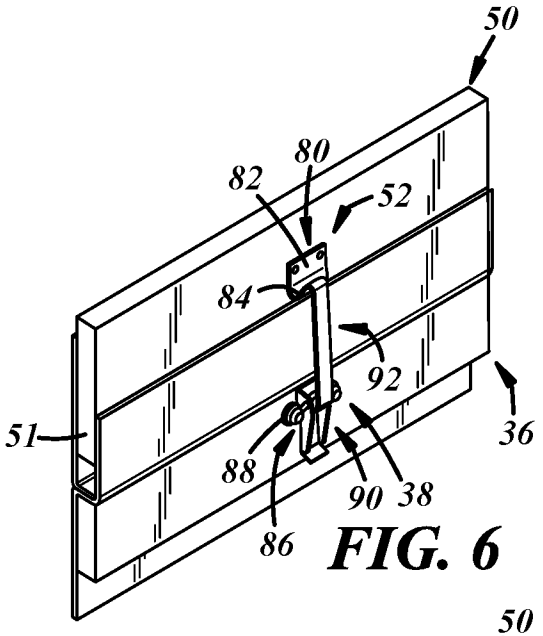
FIG. 6 is a rear perspective view of the fragmentary portion of FIG. 4.
Figure 9:
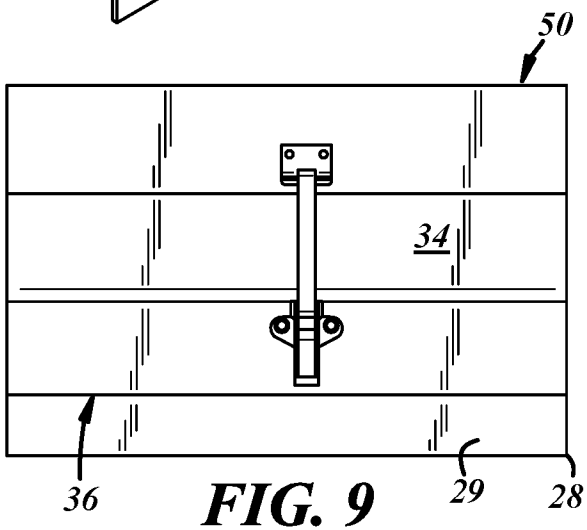
FIG. 9 is a rear elevational view of the fragmentary portion of FIG. 4.
Figure 5:
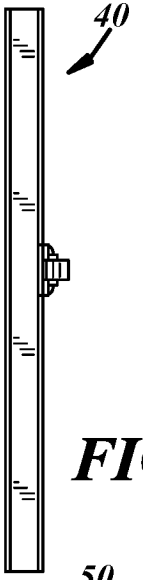
FIG. 5 is a top view of the fragmentary portion of FIG. 4.
Figure 12:
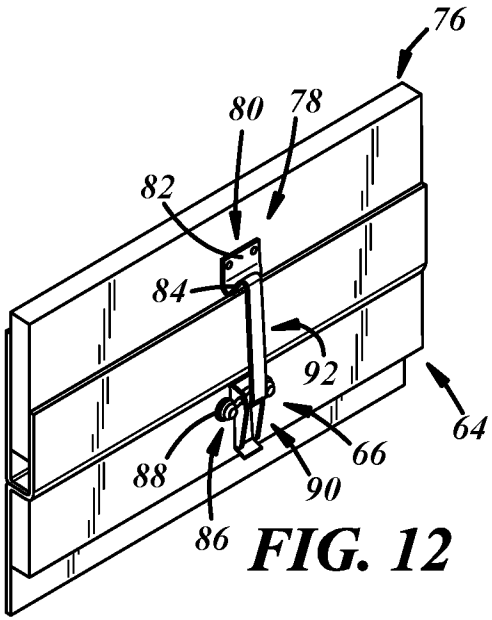
FIG. 12 is a rear perspective view of the fragmentary portion of FIG. 10.
Figure 11:
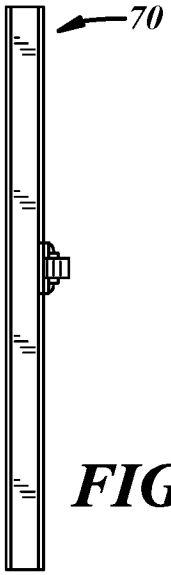
FIG. 11 is a top view of the fragmentary portion of FIG. 10.

With reference to the illustrated embodiment in FIGS. 6 and 12, the latch portions 52, 78 may include a first bracket 80 that may include a first base portion 82 that may be fastened, adhered, or otherwise coupled to its corresponding reinforcement 50, 76. The first bracket 80 also may include a lip 84 extending away from the base portion 82. In other embodiments, the latch portions 52, 78 may be integral formations of their respective reinforcements 50, 76, for instance, notches, grooves, shoulders, or the like.

The other latch portions 38, 66 may include a second bracket 86 that may include a second base portion 88 that may be fastened, adhered, or otherwise coupled to its corresponding reinforcement 36, 64, a handle 90 pivotably coupled to the second bracket 86, and an arm 92 pivotably coupled to the handle 90 and configured to engage the latch portions 52, 78, for instance, the lip 84 of the first bracket 80. Pivot axes of the handle 90 and of the arm 92 may be spaced apart.

In assembly, the basin, wall, and/or canopy sections 12, 14, 16 may be moved separately into a bathroom in which the structure 10 is to be used. Then, the canopy section 16 may be assembled on top of the wall section 14 and clamped thereto via the latches. Thereafter, the sub-assembly including the canopy and wall sections 14, 16 may be assembled on top of the basin section and clamped thereto via the latches. Finally, the completed assembly/structure 10 may be moved into a bathing alcove or any other suitable location and coupled to bathroom walls in any suitable manner.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. As used herein, the term "may" is an expedient merely to indicate optionality, for instance, of an element, feature, or other thing, and cannot be reasonably construed as rendering indefinite any disclosure herein. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Features of various implementing embodiments may be combined to form further embodiments of the invention. Therefore, the claimed invention is not limited to the particular examples of illustrative embodiments disclosed herein but, instead, is defined by the accompanying claims.

The invention claimed is:

1. A multi-section bathing structure, comprising:
- a basin section, including:
  - a basin floor;
  - a basin wall extending away from the basin floor and including:
    - a basin section offset wall portion including:
      - an upper inboard portion extending in a direction disposed at an angle less than +/−45 degrees from vertical, and
      - a basin outboard trough portion including:
        - a basin trough flange extending away from the upper inboard portion in a direction disposed at an angle less than +/−45 degrees from horizontal; and
        - a basin trough rim extending away from the basin trough flange in a generally vertical direction; and
- a wall section configured to be carried by the basin section, and including:
  - a wall including:
    - a wall section lower end extending in a direction disposed at an angle less than +/−45 degrees from vertical; and
    - a wall section outboard flange extending away from the wall section lower end in a direction disposed at an angle less than +/−45 degrees from horizontal and configured to overlap the basin trough flange of the basin outboard trough portion of the basin wall, wherein the wall section nests within the basin outboard trough portion of the basin section.

2. The multi-section bathing structure of claim 1, wherein the basin section further includes:
- a basin section reinforcement located below the basin outboard trough portion; and
- a first latch portion coupled to the reinforcement.

3. The multi-section bathing structure of claim 2, wherein the basin section reinforcement locates against a lower surface of the basin trough flange.

4. The multi-section bathing structure of claim 2, wherein the wall section further includes:
- a wall section reinforcement located above the wall section outboard flange; and
- a second latch portion coupled to the wall section reinforcement and configured for cooperation with the first latch portion to couple the basin section and the wall section together.

5. The multi-section bathing structure of claim 4, wherein a first one of the latch portions includes a first bracket with a lip, and a second one of the latch portions includes a second bracket, a handle pivotably coupled to the second bracket, and an arm pivotably coupled to the handle and configured to engage the lip of the first bracket.

6. The multi-section bathing structure of claim 4, wherein the wall section reinforcement has a lower portion located between the basin trough rim and the wall section lower end.

7. The multi-section bathing structure of claim 1, further comprising:

the wall further including a wall section offset wall portion having:

a wall section upper inboard portion extending in a direction disposed at an angle less than +/−45 degrees from vertical;

a wall outboard trough portion extending away from the wall section upper inboard portion and including:

a wall trough flange extending away from the wall section upper inboard portion in a direction disposed at an angle less than +/−45 degrees from horizontal; and a wall trough rim extending away from the wall trough flange in a direction disposed at an angle less than +/−45 degrees from vertical; and a canopy section including:

a canopy roof;

a canopy wall extending in a direction away from the canopy roof, and including:

a canopy section lower end extending in a direction disposed at an angle less than +/−45 degrees from vertical; and a canopy outboard flange extending away from the canopy section lower end in a direction disposed at an angle less than +/−45 degrees from horizontal and configured to overlap the wall outboard trough portion, wherein the canopy section is nested within the wall outboard trough portion of the wall section.

8. The multi-section bathing structure of claim 7, further comprising:

an upper wall section reinforcement located below the wall outboard trough portion;

another first latch portion coupled to the upper wall section reinforcement;

a canopy section reinforcement located above the canopy outboard flange; and another second latch portion coupled to the canopy section reinforcement and configured for cooperation with the other first latch portion to couple the canopy section and the wall section together.

9. The multi-section bathing structure of claim 8, wherein the reinforcements are longitudinally extending strips.

10. A multi-section bathing structure section, comprising:

a wall including:

an offset wall portion including:

an upper portion extending in a direction disposed at an angle less than +/−45 degrees from vertical, and an outboard trough portion including:

a flange extending away from the upper portion in a direction disposed at an angle less than +/−45 degrees from horizontal; and a rim extending away from the flange in a direction disposed at an angle less than +/−45 degrees from vertical;

a section reinforcement located below the outboard trough portion; and a latch portion coupled to the reinforcement.

11. The multi-section bathing structure section of claim 10, wherein the section is a basin section further comprising a basin floor, wherein the wall extends upwardly away from the basin floor.

12. The multi-section bathing structure section of claim 10, wherein the section is a wall section, the wall includes a wall section lower end extending in a direction disposed at an angle less than +/−45 degrees from vertical, and an outboard flange extending away from the wall section lower end in a direction disposed at an angle less than +/−45 degrees horizontal terminating the wall, and wherein the upper portion is a wall section upper end extending in a direction disposed at an angle less than +/−45 degrees from vertical, the outboard trough portion is a wall outboard trough portion extending away from the wall section upper end, and axially terminating the wall, the flange is a flange extending away from the wall section upper end, and the rim is a wall rim.

13. The multi-section bathing structure section of claim 12, further comprising a wall section reinforcement located above the outboard flange, and another latch portion coupled to the wall section reinforcement.

14. A multi-section bathing structure canopy section, comprising:

a canopy roof;

a canopy wall extending in a direction away from the canopy roof, and including:

a canopy section lower end extending in a direction disposed at an angle less than +/−45 degrees from vertical;

a canopy outboard flange extending away from the canopy section lower end in a direction disposed at an angle less than +/−45 degrees from horizontal and axially terminating the canopy wall;

a canopy section reinforcement located above the canopy outboard flange; and a latch portion coupled to the canopy section reinforcement.

* * * * *